United States Patent [19]

Cross

[11] 4,312,531

[45] Jan. 26, 1982

[54] FILLING AID FOR PLASTIC TRASH BAGS AND THE LIKE

[76] Inventor: Richard H. Cross, 2006 Le Suer Rd., Richmond, Va. 23229

[21] Appl. No.: 162,898

[22] Filed: Jun. 25, 1980

[51] Int. Cl.[3] ..... B65D 67/12

[52] U.S. Cl. ..... 294/55; 248/99; 15/257.1

[58] Field of Search ..... 294/55, 1 R, 19 R; 15/257.1, 257.7, 257.9, 104.8; 141/108, 109, 114; 248/97, 99; 222/570; 220/85 B, 85 H

[56] References Cited

U.S. PATENT DOCUMENTS

| | | | |
|---|---|---|---|
| 112,727 | 3/1871 | Lum . | |
| 1,167,782 | 1/1916 | Richards . | |
| 2,384,709 | 9/1945 | Thoren . | |
| 3,255,570 | 6/1966 | Weimer | 294/55 |
| 3,779,419 | 12/1973 | Heitz | 248/99 |
| 3,915,329 | 10/1975 | Zaks . | |
| 3,917,107 | 11/1975 | Bottas et al. . | |
| 3,936,087 | 2/1976 | Alexander | 15/257.1 |
| 3,945,314 | 3/1976 | Hennells . | |
| 4,027,774 | 6/1977 | Cote | 248/99 |
| 4,193,157 | 3/1980 | Large . | |

*Primary Examiner*—James B. Morbert

*Attorney, Agent, or Firm*—Dennison, Meserole, Pollack & Scheiner

[57] ABSTRACT

A filling aid selectively positionable within a can-received flexible bag for a stabilization and protection of the bag and a guiding of debris and the like into the bag. The aid includes an elongated tubular split sleeve having open inner and outer ends and being of a resiliently flexible nature for a selective varying of the circumferential size thereof. The outer end of the sleeve includes an outwardly curled flange engageable over a can rim for the clamping of a bag thereto. An outwardly flaring scoop extends longitudinally from the flanged end of the sleeve, tapering from engagement with the periphery of the sleeve about approximately one half the circumference thereof, to a straight outer edge of a length greater than the normal diameter of the sleeve.

6 Claims, 6 Drawing Figures

FILLING AID FOR PLASTIC TRASH BAGS AND THE LIKE

BACKGROUND OF THE INVENTION

The invention herein pertains to new and useful means for facilitating the filling and handling of conventional plastic trash bags and the like.

The conventional plastic trash bag, normally formed of extremely thin and flexible plastic, for example low density polyethylene, has come into common usage for a great variety of purposes both around the home and elsewhere. The widespread acceptance and use of such bags evidences their basic practicality, notwithstanding that the extremely flexible or flacid nature of such bags makes them difficult to fill and handle, and easily torn when sharp edged materials are packed therein.

One of the more common uses of the larger sizes of such bags, and an area wherein the present invention is particularly, although not exclusively, concerned, is in the collecting of lawn and garden debris which ranges from heavy compacted grass clippings to sharp edged twigs, small branches, and the like. The use of such bags in this environment is less than completely convenient in view of the flexible nature of the bag and the necessity for retaining the bag, and particularly the mouth thereof, open in order that the debris might be either dropped therein or in some manner swept therein. One proposed solution to this problem will be noted in U.S. Pat. No. 4,193,157 issued to Helen F. Large, wherein a plastic hoop is inserted into the open mouth of the bag and a ramp provided in outwardly extending relation to the hoop for the inward guiding of swept debris. Similar bag mouth engaging devices will also be noted in U.S. Pat. No. 112,727 issued to W. F. Lum, and U.S. Pat. No. 1,167,782 issued to J. W. Richards.

Other proposals for stabilizing flexible bags will be noted in the following U.S. Pat. Nos.:

2,384,709 Thoren;
3,915,329 Zaks;
3,917,107 Bottas et al;
3,945,314 Hennells.

Zaks proposes a filling device for plastic trash bags which is frusto-conical and received, as a liner, within a plastic bag which may in turn be supported by the liner. Bottas et al and Hennells are concerned with refuse compactors and provide inner supports for bags which are in turn received within receptacles. This is also generally shown in Thoren wherein the inner support is in the nature of a collar.

While not specifically noted in the above patents, it is also a common expedient to provide a plastic bag within a conventional trash can with the upper portion of the bag draped over the side of the can, thus providing some degree of stability to the flexible bag during the loading thereof. However, a major problem encountered with such an arrangement is the tendency for introduced debris, particularly when involving prickly branches, twigs and the like, to tear or shred the bag. This occurs both during the introduction of the material and as the loaded bag is being removed. There is also the problem of the bag slipping into the supporting can or receptacle during the loading.

SUMMARY OF THE INVENTION

It is a primary intention of the present invention to provide a filling aid or device which, when used in conjunction with a conventional trash can, provides an effective means for positioning and stabilizing a flexible trash bag, protecting the bag against destructive tears and the like, stabilizing the assembled apparatus in a position whereby debris can be directly swept or raked thereinto, and providing a guidance means which facilitates a direct introduction of debris into the bag and at the same time provides a convenient assist for firmly packing the debris into the bag.

Basically, the filling aid includes an elongated tubular sleeve open at the opposite upper and lower ends and longitudinally slit along the full length thereof. The upper end of the sleeve has a full peripheral outwardly and downwardly turned edge flange.

A scoop, either integrally formed with or intimately attachable to the sleeve, extends longitudinally outward from the upper end of the sleeve immediately inward of the outwardly turned edge flange, the scoop providing in effect a smooth continuation of the inner wall of the sleeve. The inner edge of the scoop, the edge engaged with the upper end of the sleeve, is of an arcuate configuration, extending about approximately one half the circumference of the open end of the sleeve. The outer edge of the scoop is straight and of a length greater than the normal diameter of the sleeve. The opposed ends of this outer edge curl slightly inwardly into the opposed sides of the scoop which extend to the arcuate inner edge of the scoop and define, in conjunction with the body of the scoop, an overall tapered configuration which is substantially semicircular at the top end of the sleeve for a direct flow of debris into the sleeve. The outer edge portion of the scoop, remote from the sleeve, is planar to provide a stabilizing ground engaging portion with a wide entry area into which debris can easily be swept or raked.

It is contemplated that the filling aid be formed of relatively rigid plastic, such as for example a high density polyethylene, which incorporates a degree of inherent resiliency sufficient at least to enable a circumferential adjustment of the sleeve, provided for by the longitudinal slit. Other appropriate material, such as for example sheet metal, might be used if deemed appropriate. Further, should the scoop be formed as an attachable component, for example to facilitate packing and shipping, the sleeve portion of the aid might be formed of plastic and the scoop of sheet metal.

In actual size, the sleeve, normally through an initial circumferential collapsing thereof, is inserted within a plastic trash bag which is in turn received within a conventional rigid trash can. The sleeve extends to a point closely adjacent the bottom of the can so as to protect the bag along substantially the full height thereof. The upper edge of the bag is in turn folded over the upper rim of the can and frictionally locked thereto by the sleeve edge flange. The can is then laid on its side with the planar outer portion of the scoop directly engaging the ground and providing a wide mouth for the sweeping of the debris into the liner protected bag.

After a loading of the debris and a reasonable compacting thereof through the action of the rake, broom or the like, additional debris is loaded onto the scoop and the entire assembly positioned upright. The scooped debris, through the funnel-shaped nature of the scoop, will feed into the can assembly, and act to further compact the material therein, either with or without a little pressure assist from the user.

The entire assembly can be easily carried, through the conventionally provided handles on the can, to the point of disposal. The bag and the liner formed sleeve can then be removed as a unit from the can with the sleeve still affording substantial protection to prevent damage to the bag by the debris. Further, the relatively rigid nature of the sleeve greatly simplifies a removal from the can. Ultimately, the sleeve is slipped from the bag and the bag tied for disposal. In slipping the liner from the bag, it will be appreciated that while there does exist some possibility of sharp twigs or the like poking into the bag and causing minute holes, there is substantially no danger of destructive long tears or rips being formed, as would be the case were the debris forced directly into the plastic bag itself, or were the debris allowed to poke through the bag prior to removal of the bag from the can.

It will be readily appreciated that additional objects and advantages, which will become subsequently apparent, reside in the details of construction and operation of the invention as more fully hereinafter described and claimed.

DESCRIPTION OF THE PREFERRED EMBODIMENTS

Figure 1:
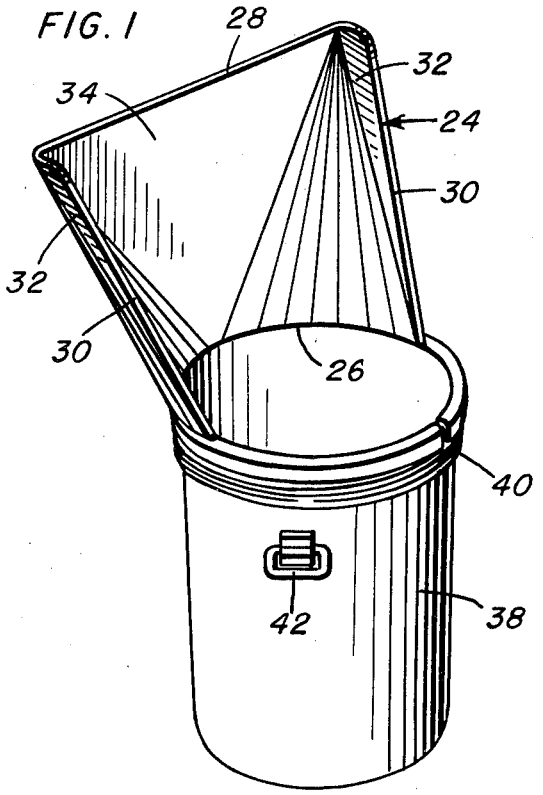
FIG. 1 is a perspective view of the entire debris receiving assembly.
Figure 4:
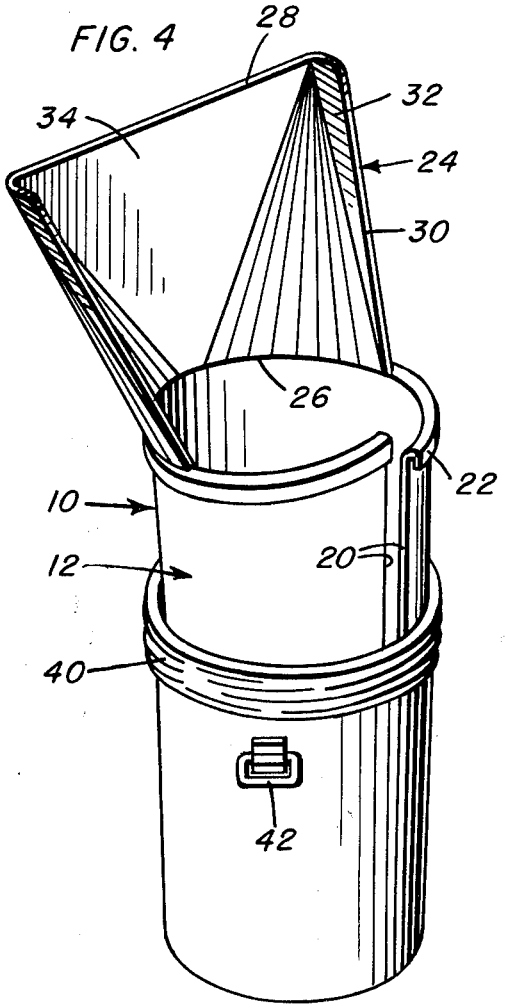
FIG. 4 is an illustration of the assembling of the components.
Figure 2:
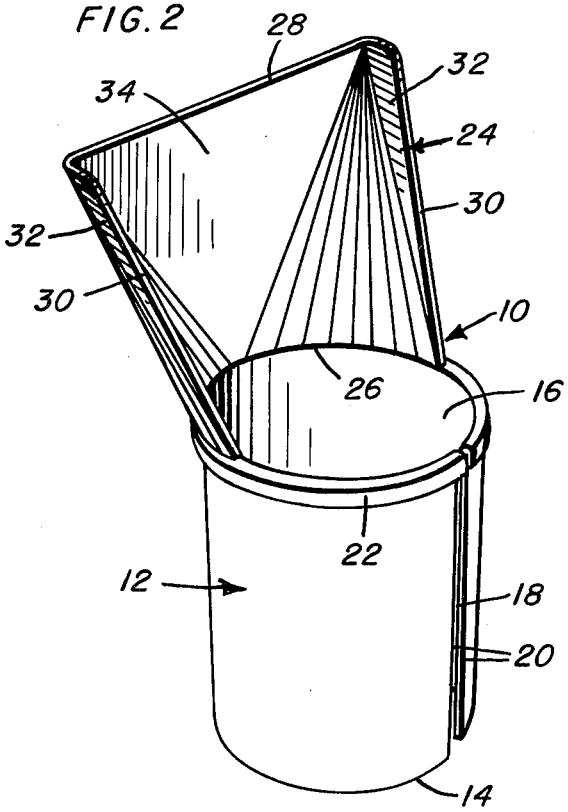
FIG. 2 is a perspective view of the filling aid itself.

Referring now more specifically to the drawings, reference numeral 10 is used to generally designate the filling aid comprising the present invention. The filling aid includes an elongated tubular sleeve 12 having open bottom and top ends 14 and 16 respectively. The sleeve, in order to allow for a circumferential adjustment, is provided with a full length longitudinal slot 18 defined by a pair of parallel longitudinal sleeve edges 20. The circumferential adjustment of the sleeve 12 is effected manually, and made possible by both the tubular configuration of the sleeve and the use of an appropriate relatively rigid plastic, such as high density polyethylene, having an inherent degree of resiliency. As an example of the use of such material, attention is directed to the conventional plastic garbage can. The sleeve is completed by providing the upper edge of the sleeve, about the open end 16 thereof, with a full length outwardly and downwardly turned edge flange 22, the purpose for which shall be explained subsequently.

Figure 3:
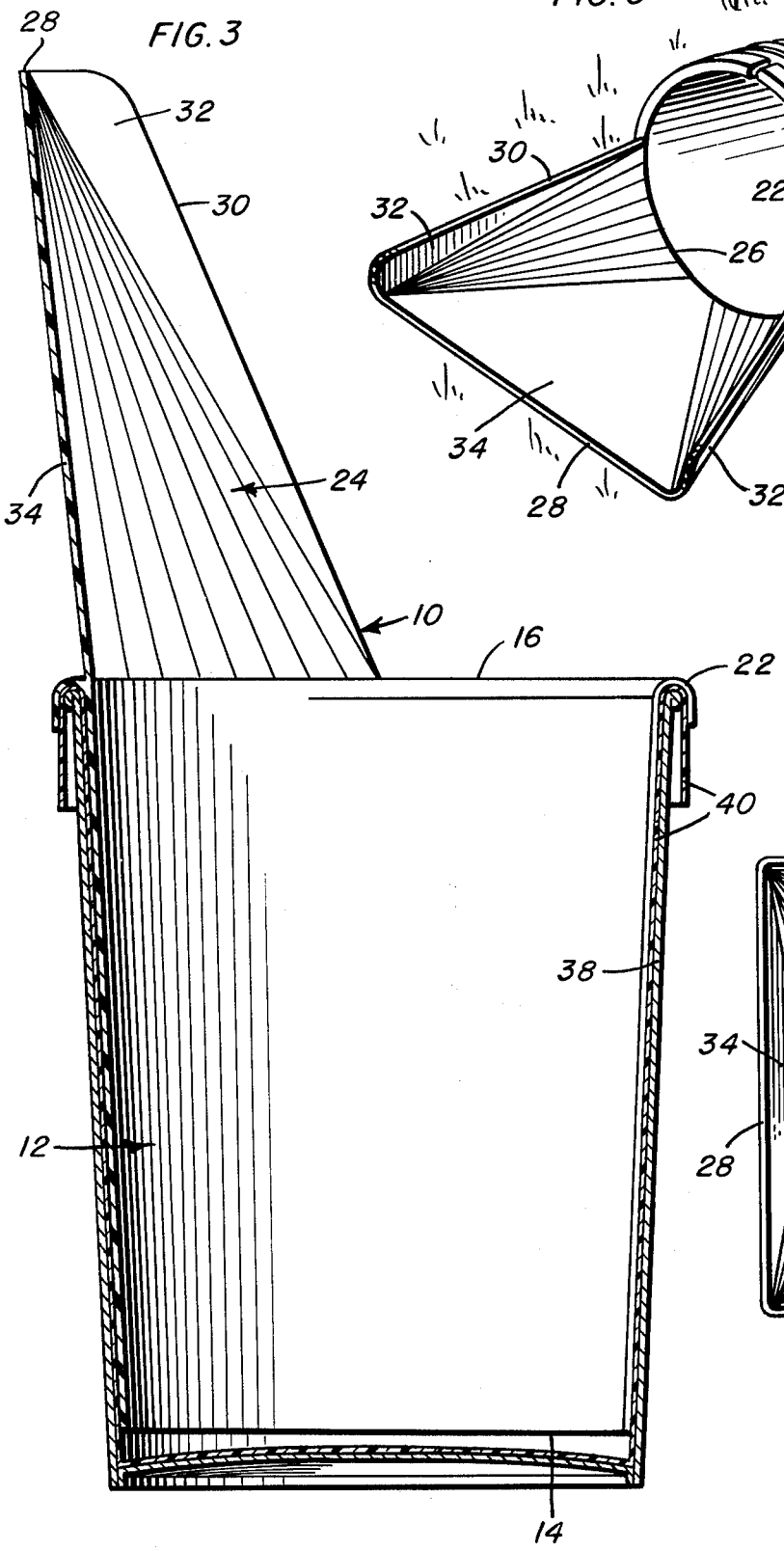
FIG. 3 is a longitudinal cross-sectional view through the assembly of FIG. 1.
Figure 5:
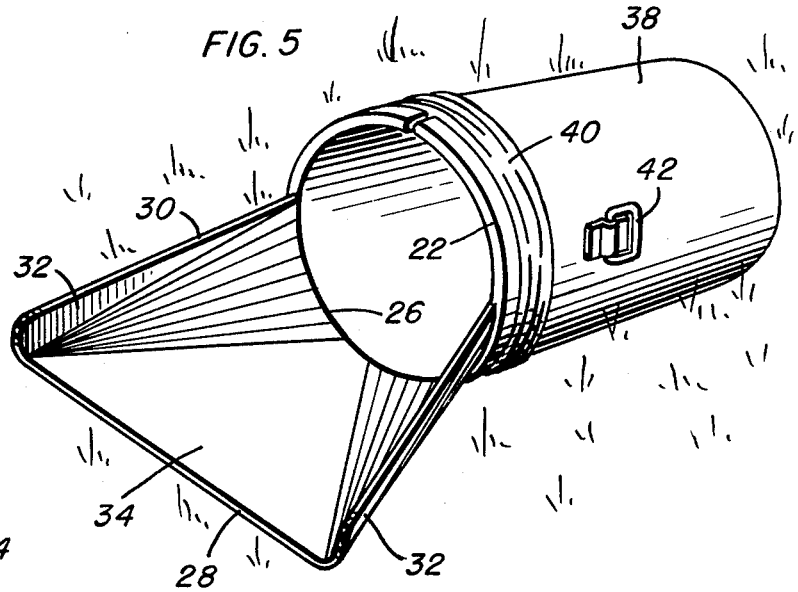
FIG. 5 is a perspective view of the assembly in position to receive debris.
Figure 6:
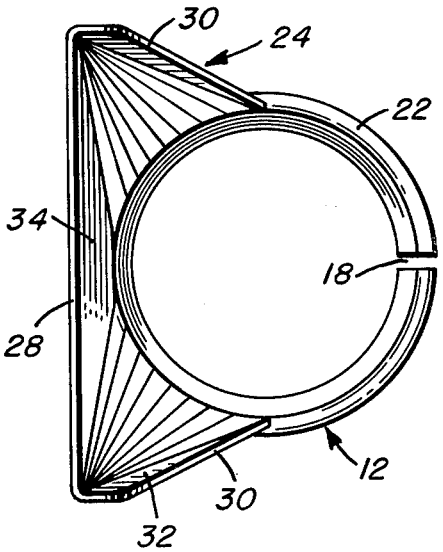
FIG. 6 is a top plan view of the filling aid.

The filling aid 10 also includes an enlarged debris funneling scoop 24 which, as illustrated, may be integrally formed with the sleeve 12. The scoop 24 includes an arcuate inner edge 26 which conforms to and extends about approximately one half of the circumference of the open outer end 16 of the sleeve 12. This inner edge 26 of the scoop 24 is positioned whereby the scoop surface forms a substantially smooth continuation of the aligned inner surface of the sleeve 12. As will be best noted in the cross-sectional view of FIG. 3, the reversely turned edge flange 22 continues behind the inner edge 26 of the scoop 24.

The outer edge 28 of the scoop is straight and of a length greater than the diameter of the sleeve 12, projecting equally beyond diametrically opposed points on the sleeve whereby a tapered configuration is provided with the scoop defining a generally funneling configuration from the planar outer edge portion to the semi-circular sleeve engaged inner edge portion.

The opposed side edges 30 are straight and extend slightly divergently from diametrically opposed points at the upper reversely turned rim of the sleeve to arcuate outer corners which merge with the transverse straight outer edge 28.

The portions 32 of the scoop 24, immediately adjacent the side edges 30, are planar or flat and project generally in a plane perpendicular to the flat central portion 34 which defines an area tapering from a maximum width along the straight outer edge 28 to a minimal width at the inner edge 26 adjacent the open end 16 of the sleeve 12. The arcuate configuration of the scoop, between the flat central portion 34 and each of the generally perpendicular edge portions 32, can be of a constant tapered curvature, or formed of a series of individual folds, each extending from a point 36, generally at the juncture between the straight outer edge 28 and the arcuate corner, and a series of circumferentially spaced points along the inner edge 26 of the scoop 24. The generally perpendicular orientation of the side edge portions 32 provides for a positive and effective retention of the debris being moved through the scoop.

Other features which will be noted from the drawings include the provision of the adjustment accommodating slit 18 at a point circumferentially about the sleeve 12 away from the scoop. Further, it will be noted that the scoop is angled slightly laterally outward so as to provide for a positive engagement of the straight outer edge 28 thereof with the ground during the use of the filling aid as will be described presently.

While the scoop has been described as being integrally formed with the sleeve, if desired for shipping or storing purposes, or as a matter of convenience, the scoop can be separately formed and even formed of a different material, however, this will necessitate means for effecting a positive interlock of the scoop with the sleeve in an appropriate manner.

As will be appreciated from the drawings, the filling aid 10 is specifically adapted and intended for use in conjunction with a conventional receptacle or can 38 as a means for positioning, stabilizing and filling a conventional flexible trash bag 40.

For purposes of illustration, the outer rigid trash receptacle or can 38 has been illustrated as a conventional 26-gallon garbage can, normally having opposed carrying handles 42. Other sizes and forms of open topped containers or receptacles can also be used, with the filling aid, in each instance, being formed for use in conjunction with the particular receptacle or closely sized similar receptacles. For example, while the illustrated filling aid has been presented as being of a size for specific use with a conventional 26-gallon can, due to the adjustable nature of the filling aid, other similarly sized receptacles can be used, for example a conventional 30-gallon can.

In use, a flexible bag 40 is placed within the can 38 and internally receives the sleeve 12 for a sandwiching of the bag between the sleeve and can. This can be effected in either of two ways. First, the bag can be manually placed within the can with the closed bottom of the bag resting on the closed bottom of the can and with the open end of the bag having the edge portion thereof draped over the can rim. After the bag is so positioned, and manually opened at least to a degree sufficient to accommodate the collapsed sleeve, the sleeve 12 is circumferentially constricted, possibly forming a slight tapering thereof toward the lower end, and introduced into the can supported bag, taking care not to push the bag completely into the can. Once properly positioned, the sleeve is allowed to expand, possibly being manually assisted, so as to bring the bag into snug engagement with the inner wall of the can or receptacle. After an expansion of the sleeve so as to effect the snug engagement of the bag against the can wall, the reversely turned flanged upper edge of the sleeve is forced downwardly over the can rim so as to frictionally clamp the upper edge of the bag therebetween, thus avoiding any tendency for the bag to slip into the can during the filling thereof.

As an alternate manner of assembling the filling aid, bag and can, the sleeve of the filling aid can be introduced directly into the flexible bag, or the bag slid over the sleeve, collapsing the sleeve to the degree necessary to accommodate the bag, with the then assembled sleeve and bag introduced into the can. Again, care is taken to provide a snug sandwiching of the bag between the sleeve and the surrounding can wall, along with a firm frictional clamping of the outer portion of the bag over the can rim. By extending the reversely turned flange on the open upper end of the sleeve along the full length thereof, even throughout the full extent of the scoop immediately outward thereof, a positive retention of the bag is effected peripherally thereabout.

It will be appreciated that the peripheral contractible nature of the sleeve allows for its accommodation in cans of varying diameter, as well as cans which might incorporate a slight degree of taper therein, in which instance, the overlap between the adjoining free edge sections of the sleeve will be greater toward the tapered small end of the can.

Ideally, the sleeve 12 will form a liner for the full height of the bag 40 within the can 38. This is significant in that the greatest damage to the conventional thin plastic bags arises from sharp articles, branches, and the like being pushed into plastic bags and along the length thereof whereby long tears or slits are formed. With the liner forming sleeve of the present invention, the sleeve itself, formed of a heavy gauge plastic or the like, easily resists any destructive tearing or slitting.

While it is preferred that the sleeve extend the full height of the can received bag, in leaving of a small exposed section of the bag below the lower end of the sleeve, such as would occur were the filling aid for a 26-gallon can used in a 30-gallon can, little destructive tearing would occur in that a substantial radial inward compressing and settling of the debris would occur as the debris travels the full height of the sleeve. Further, a little judicious packing of the debris could easily accommodate a slight exposure of the lower portion of the bag. For example, softer materials, such as grass or the like, can be introduced to form a mat at the bottom of the bag, prior to the packing of branches or the like therein.

When laid on the ground, the scoop 24, an integral part of the filling aid, provides, at its outer edge, a wide flat ground engaging mouth into which debris is easily swept or raked. The tapered configuration of the scoop, along with the perpendicular side edge portions, easily and conveniently funnel the debris into the tubular sleeve, and thus into the receptacle mounted bag without significant contact with any portion of the bag, other than the closed end thereof, until such time as the sleeve is removed. The wide flat outer edge of the scoop stabilizes the normally cylindrical receptacle, preventing any tendency for the receptacle to roll or turn as the debris is loaded therein.

After a fairly tight compacting of the debris into the assembly, utilizing the raking or sweeping implement, the scoop itself can be provided with a final load of debris and the assembly swung upward. The funnel shaped scoop will tend to retain the debris thereon and provide a converging path down which the debris moves to further compact the material into the receptacle and sleeve-supported bag. Should it be considered desirable, a minor degree of tamping can assist in compacting the debris within the bag received sleeve. However, no substantial physical force, as for example a stepping into the can, will be required in that the major compacting force will be derived from the material within the enlarged scoop itself moving downward and inward.

The removal of the loaded bag, or the handling of the assembly, can be effected in any of a variety of convenient ways. For example, the filling aid and bag can remain in the can while the entire assembly is conveniently carried, by the can handles, to a point of disposal, after which the filling aid and bag are separated as a unit from the can with the final step involving a sliding of the sleeve from the bag. In this manner, the bag is at no time subjected to a sliding movement of sharp twigs, branches, or the like therealong, such as could cause destructive tears or slits. As an alternative manner of removing the bag, the first step can involve a sliding of the sleeve from the can-received bag, after which the loaded bag is itself slid from the can. This procedure, depending on the nature of the debris, might be slightly more difficult in that the debris confining force of the relatively stiff sleeve will have been removed.

The foregoing is considered illustrative only of the principles of the invention. Further, since modifications and changes may readily occur to those skilled in the art, it is not desired to limit the invention to the exact construction and operation shown and described. Accordingly, all suitable modifications and equivalents may be resorted to, falling within the scope of the invention as claimed.

I claim:

1. For use in combination with a self-sustaining receptacle for the loading of a bag of flexible material, the receptacle having a closed bottom and a rim defined open top, said bag having a closed bottom and an open top; a filling aid, said aid including a protective sleeve positionable within a receptacle-received bag for a sandwiching of the bag between the sleeve and the surrounding receptacle, said sleeve including an open inner end positionable adjacent the bottom of the bag, and an open outer end including means for engaging and clamping the open top of the bag to the open top of the receptacle peripherally thereabout, said filling aid further including a scoop extending longitudinally from the outer end of the sleeve, said scoop having an inner edge conforming to and integral with the outer end of the sleeve about a substantial portion of the periphery thereof, said scoop further including a planar central portion with a straight outer edge and opposed sides formed to define a smooth transition area for the movement of debris from the outer edge to the periphery-conforming inner edge and the open outer end of the sleeve thereat, said means for engaging and clamping the open top of the bag to the open top of the receptacle comprising a reversely turned edge flange on the outer end of said sleeve peripherally thereabout, said edge flange being engageable over the top defining rim of the receptacle with the open top of the bag being frictionally retained therebetween.

2. The filling aid of claim 1 wherein said sleeve includes means for enabling a selective variation in the circumferential size of the sleeve comprising a full length slit in said sleeve defining selectively overlappable longitudinal edges.

3. The filling aid of claim 2 wherein said reversely turned edge flange is continuous between the slit defined longitudinal edges of the sleeve.

4. The filling aid of claim 3 wherein the inner edge of the scoop conforms to at least approximately one half the periphery of the outer end of the sleeve, said outer edge being of a length greater than the width of the scoop at the inner edge thereof.

5. The filling aid of claim 4 wherein the opposed sides of said scoop include planar side portions generally perpendicular to the planar central portion, said planar side portions converging inwardly from the opposite ends of the outer edge of the scoop to the outer end of the sleeve at approximately diametrically opposed points.

6. The filling aid of claim 1 wherein the inner edge of the scoop conforms to at least approximately one half the periphery of the outer end of the sleeve, said outer edge being of a length greater than the width of the scoop at the inner edge thereof, the opposed sides of said scoop including planar side portions generally perpendicular to the planar central portion, said planar side portions converging inwardly from the opposite ends of the outer edge of the scoop to the outer end of the sleeve at approximately diametrically opposed points.

* * * * *